US009902148B2

(12) United States Patent
Liu et al.

(10) Patent No.: US 9,902,148 B2
(45) Date of Patent: Feb. 27, 2018

(54) EJECTION DEVICE

(71) Applicant: FUNAI ELECTRIC CO., LTD., Osaka (JP)

(72) Inventors: Minghui Liu, Higashiosaka (JP); Yasunori Matsuda, Yawata (JP)

(73) Assignee: FUNAI ELECTRIC CO., LTD., Osaka (JP)

( * ) Notice: Subject to any disclaimer, the term of this patent is extended or adjusted under 35 U.S.C. 154(b) by 14 days.

(21) Appl. No.: 15/206,314

(22) Filed: Jul. 11, 2016

(65) Prior Publication Data

US 2017/0008275 A1 Jan. 12, 2017

(30) Foreign Application Priority Data

Jul. 9, 2015 (JP) ..... 2015-138028
Jun. 27, 2016 (JP) ..... 2016-126372

(51) Int. Cl.

| | |
|---|---|
| ***B41J 29/38*** | (2006.01) |
| ***B41J 2/045*** | (2006.01) |
| ***B41J 3/407*** | (2006.01) |
| ***B41J 11/00*** | (2006.01) |

(52) U.S. Cl.

CPC ..... *B41J 2/04505* (2013.01); *B41J 2/04586* (2013.01); *B41J 3/4073* (2013.01); *B41J 11/0095* (2013.01)

(58) Field of Classification Search

None

See application file for complete search history.

(56) References Cited

U.S. PATENT DOCUMENTS

| | | | | |
|---|---|---|---|---|
| 6,286,517 | B1 | 9/2001 | Weber et al. | |
| 9,022,522 | B2 | 5/2015 | Hori | |
| 2007/0064041 | A1* | 3/2007 | Sugahara | B41J 3/543 347/19 |
| 2007/0085872 | A1* | 4/2007 | Teradaira | B41J 29/393 347/19 |
| 2012/0147113 | A1* | 6/2012 | Yamasaki | A45D 29/00 347/104 |
| 2013/0342595 | A1* | 12/2013 | Hasegawa | B41J 29/393 347/8 |
| 2016/0159117 | A1* | 6/2016 | Gurak | G01B 11/00 347/16 |

FOREIGN PATENT DOCUMENTS

| | | |
|---|---|---|
| CN | 103935124 | 7/2014 |
| JP | 2012-245079 | 12/2012 |

* cited by examiner

*Primary Examiner* — Matthew Luu
*Assistant Examiner* — Tracey McMillion
(74) *Attorney, Agent, or Firm* — JCIPRNET

(57) ABSTRACT

An ejection device capable of preventing a discharge part from contacting an object is provided. The ejection device has a discharge part, a light projecting part, a light receiving part and a controller. The discharge part discharges a droplet to an object. The light projecting part projects a light between the discharge part and the object to form a light path across the object, and the light receiving part receives the light projected by the light projecting part. The controller stops driving the discharge part when the light receiving part does not receive the light.

18 Claims, 17 Drawing Sheets

EJECTION DEVICE

CROSS-REFERENCE TO RELATED APPLICATION

This application claims the priority benefits of Japan application serial no. 2015-138028, filed on Jul. 9, 2015 and Japan application serial no. 2016-126372, filed on Jun. 27, 2016. The entirety of each of the above-mentioned patent applications is hereby incorporated by reference herein and made a part of this specification.

BACKGROUND OF THE INVENTION

Field of the Invention

The invention relates to an ejection device.

Description of Related Art

As an example of ejection devices, a conventional printer (e.g., a nail printer that performs printing on a nail of a finger which serves as an object) is provided, which moves a print head, i.e., discharge part, along a predetermined scanning direction and discharges ink onto the object (e.g., the nail of the finger), so as to perform printing on the object (see Patent Literature 1, for example, Japanese Patent Publication No. 2012-245079).

In order that the ink can fall onto the correct position on the nail of the finger, it is necessary to shorten the distance between the print head and the nail. As the distance between the nail and the print head decreases, however, if the fingertip moves up, the print head may contact the nail and dirty the finger or the nail, and the print head may be damaged.

Thus, in the invention of Patent Literature 1, a push switch is provided on a finger placing surface, on which the finger is placed. The print head carries out the printing operation when the push switch is pressed by the finger and stops the printing operation when the finger moves away from the push switch.

However, the invention of Patent Literature 1 faces the problem that the print head can not avoid form contacting the object even though the push switch is pressed.

Specifically, if the nail, i.e., the object, has been applied with decoration, the print head may come into contact with the decoration material that protrudes on the surface of the nail even when the push switch is pressed. Consequently, the impact may be transmitted to the nail through the decoration material and cause the fingertip to move up, and the finger or nail may be contaminated and the print head may be damaged.

SUMMARY OF THE INVENTION

In view of the above, the disclosure provides an ejection device that is capable of preventing the print head, i.e., discharge part, from contacting the object.

In an embodiment of the invention, an ejection device includes: a discharge part discharging a droplet to an object; a light projecting part projecting a light between the discharge part and the object to form a light path across the object; a light receiving part receiving the light projected by the light projecting part; and a controller stopping driving the discharge part when the light receiving part does not receive the light. In this embodiment, the ejection device further includes an object placing part, on which the object is placed. The light path inclines at a predetermined angle with respect to at least a first direction of the discharge part.

In this embodiment, the light path that propagates across the object between the discharge part and the object is formed by the light projecting part and the light receiving part. When the light is blocked by the object, the light is not received by the light receiving part and the driving of the discharge part is stopped. Here, the object refers to a nail of a finger, for example.

According to this configuration, the discharge part is prevented from contacting the object, so as to ensure safety. In addition, contamination of the object and damage of the discharge part do not occur.

Regarding the ejection device of the above embodiment, the light path may incline at the predetermined angle with respect to the first direction.

In this embodiment, the light is projected in a direction inclined at the predetermined angle with respect to the first direction to form the light path. In other words, the light path of the light projected in the inclined direction is longer than the light path of the light projected in the first direction. Thus, by inclining the light path, the area of the object irradiated by the light is increased and the performance of detection of the object is enhanced to improve the safety.

In the ejection device of the above embodiment, the light projecting part and the light receiving part are disposed outside a movement range of the discharge part.

In this embodiment, when the droplet is discharged to the object by the discharge part, the discharge part does not interfere with the light projecting part and the light receiving part.

The ejection device of the above embodiment may include a reflecting part that reflects the light projected by the light projecting part to propagates across the object at least one time.

In this embodiment, the light is reflected by the reflecting part, such that the area of the object irradiated by the light is larger in comparison with the case where the light propagates across the object only one time.

Moreover, in the ejection device of the above embodiment, the reflecting part may be disposed respectively on one end side and another end side of the object in the first direction.

In this embodiment, the light is reflected between a pair of the reflecting parts, so as to form a light path that propagates across the object multiple times. According to this configuration, the object may be detected over a wide range, and the detection performance is enhanced to improve the safety.

In addition, in the ejection device of the above embodiment, the light projecting part and the light receiving part may be disposed respectively on one end side and another end side of the object.

In the ejection device of the above embodiment, the light projecting part and the light receiving part may also be disposed on one end side of the first direction of the object. Besides, the light projecting part and the light receiving part may be mounted on a substrate.

In this embodiment, the light projecting part and the light receiving part are respectively disposed on one end side of the object in the first direction. Therefore, it is possible to mount the light projecting part and the light receiving part on one printed board (substrate), which includes a circuit and still has a simple structure.

Moreover, in the ejection device of the above embodiment, the light projecting part and the light receiving part are directed in a second direction from the object and disposed at separated positions, wherein the second direction is perpendicular to the first direction, and may include a light projecting side guiding part, which guides the light projected by the light projecting part to propagates across the object, and a light receiving side guiding part, which guides the light propagating across the object to the light receiving part.

In this embodiment, the light projecting part and the light receiving part are disposed at positions away from the object placing part in the second direction. The light projected by the light projecting part is guided by the light projecting side guiding part to propagate across the object and then guided to the light receiving part by the light receiving side guiding part.

According to this configuration, the arrangement and positions of the light projecting part and the light receiving part may be set at will when forming the light path.

Specifically, if the light projecting part and the light receiving part are to be disposed on the movement path of the discharge part, in order to avoid interference with the discharge part, the light projecting part and the light receiving part have to be disposed outside the movement range of the discharge part.

In contrast thereto, in this embodiment, the light projecting part and the light receiving part are disposed at positions away from the movement path of the discharge part in the second direction, and the light is guided by the light projecting side guiding part and the light receiving side guiding part. Thereby, the light projecting part and the light receiving part may be disposed near the object without considering the movement range of the discharge part and the design may be made to satisfy needs such as miniaturization of the device.

Furthermore, in the ejection device of the above embodiment, the light projecting part includes a line laser light source that is disposed on one end side of the first direction of the object and projects a laser light that spreads radially to form a light path across the object while a plurality of the light receiving parts are disposed on another end side of the first direction of the object.

In this embodiment, the laser light that is projected by the light projecting part and spreads radially is received by the light receiving parts after propagating across the object. According to this configuration, a wide area of the object may be detected by the radially spreading laser light, and the detection performance is enhanced to improve the safety.

In the ejection device of the above embodiment, the controller may stop a motor of the discharge part to stop driving the discharge part. Additionally, in the ejection device of the above embodiment, the controller may control to turn off a power supply of a driver of the motor to stop driving the discharge part.

The ejection device of the above embodiment may include a display that displays an error message indicating that the driving of the discharge part is stopped.

In this embodiment, the discharge part is prevented from contacting the object, so as to ensure safety. In addition, contamination of the object and damage of the discharge part do not occur.

Further, regarding the ejection device of the above embodiment, the printer performs printing by discharging the droplet to the object while moving at least along the first direction.

According to the invention, the discharge part is prevented from contacting the object, so as to ensure safety. In addition, contamination of the object and damage of the discharge part do not occur.

DESCRIPTION OF THE EMBODIMENTS

Hereinafter, embodiments of the invention are described in detail with reference to the figures. The description of the embodiments below is merely exemplary in nature and is not intended to limit the invention, application, or use thereof. Moreover, in the following embodiments, a printer and a printer head thereof are described as examples of the ejection device and the discharge part respectively.

First Embodiment

Figure 1:
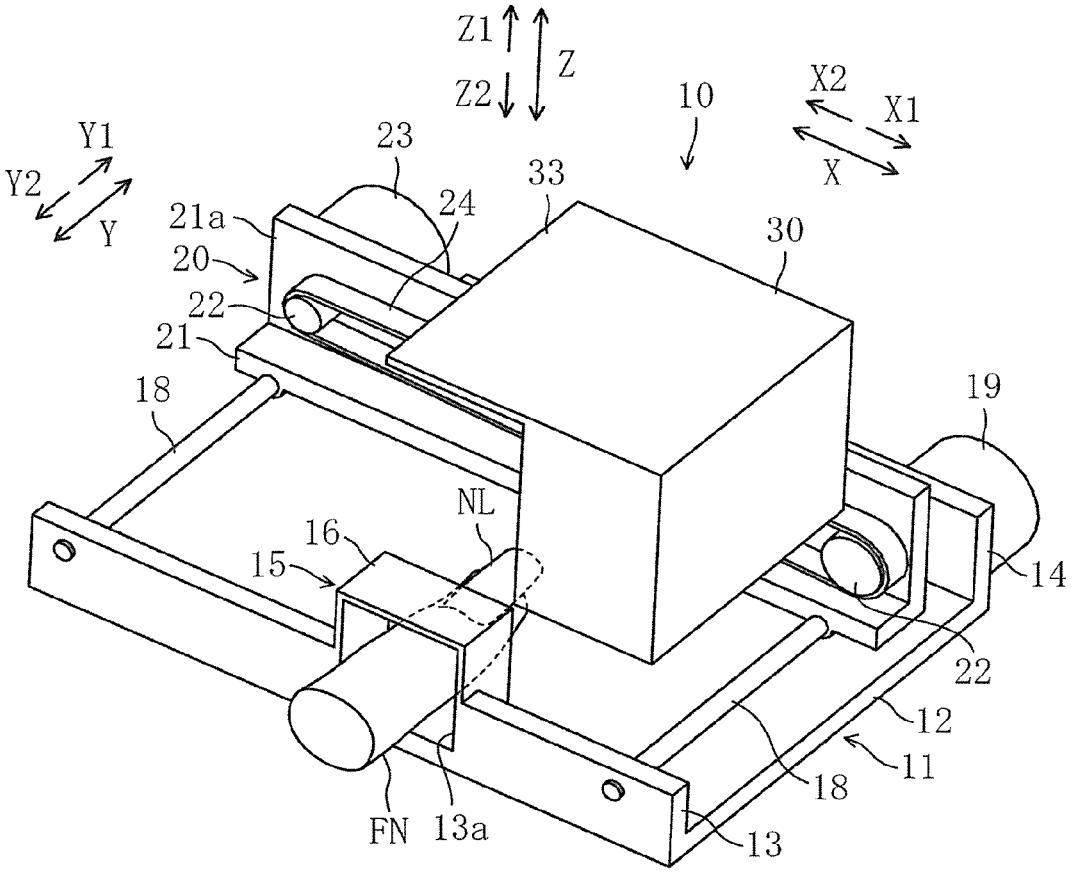
FIG. 1 is a perspective view showing the configuration of a printer according to the first embodiment.
Figure 2:
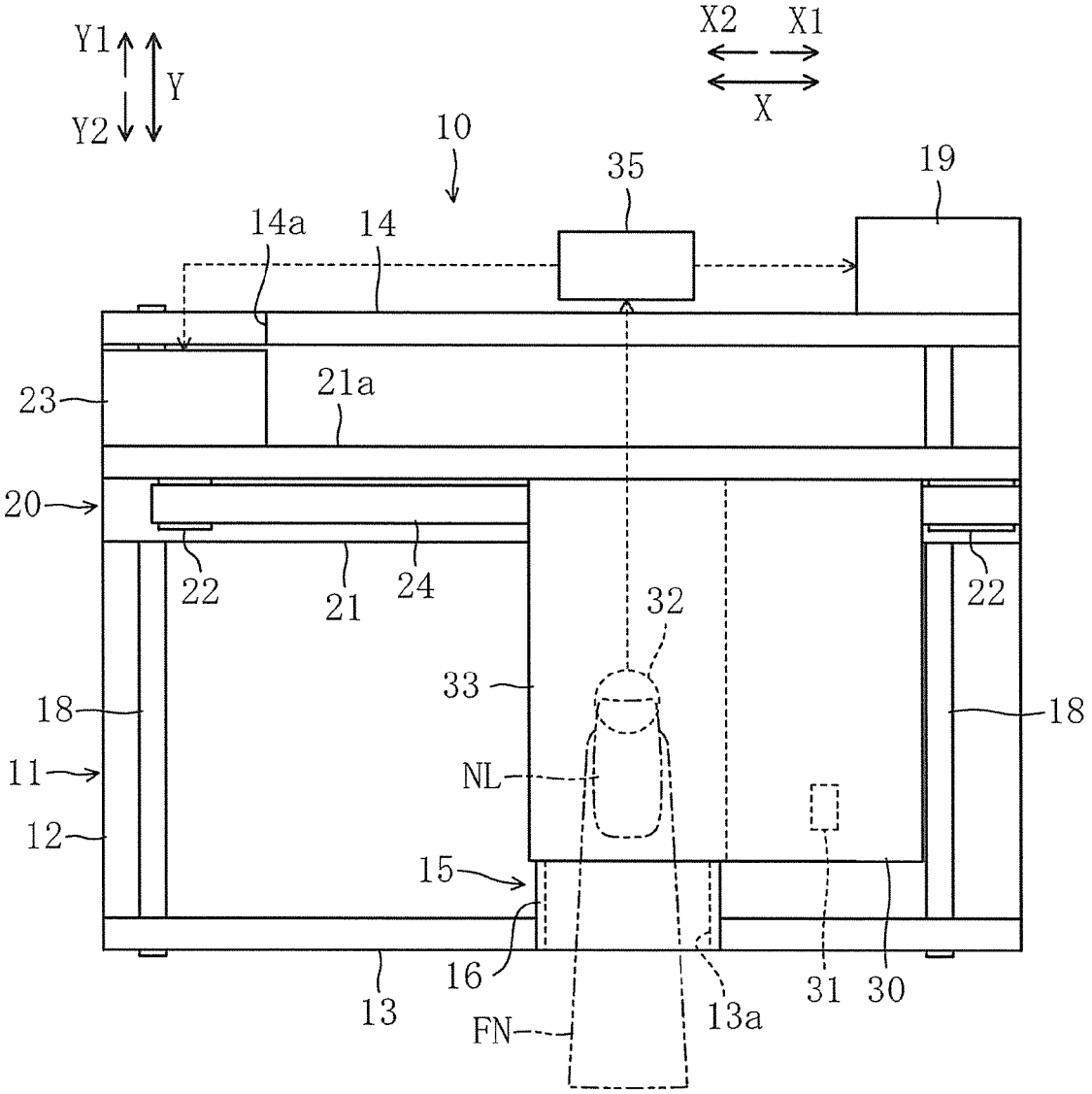
FIG. 2 is a plan view showing the configuration of the printer.
Figure 3:
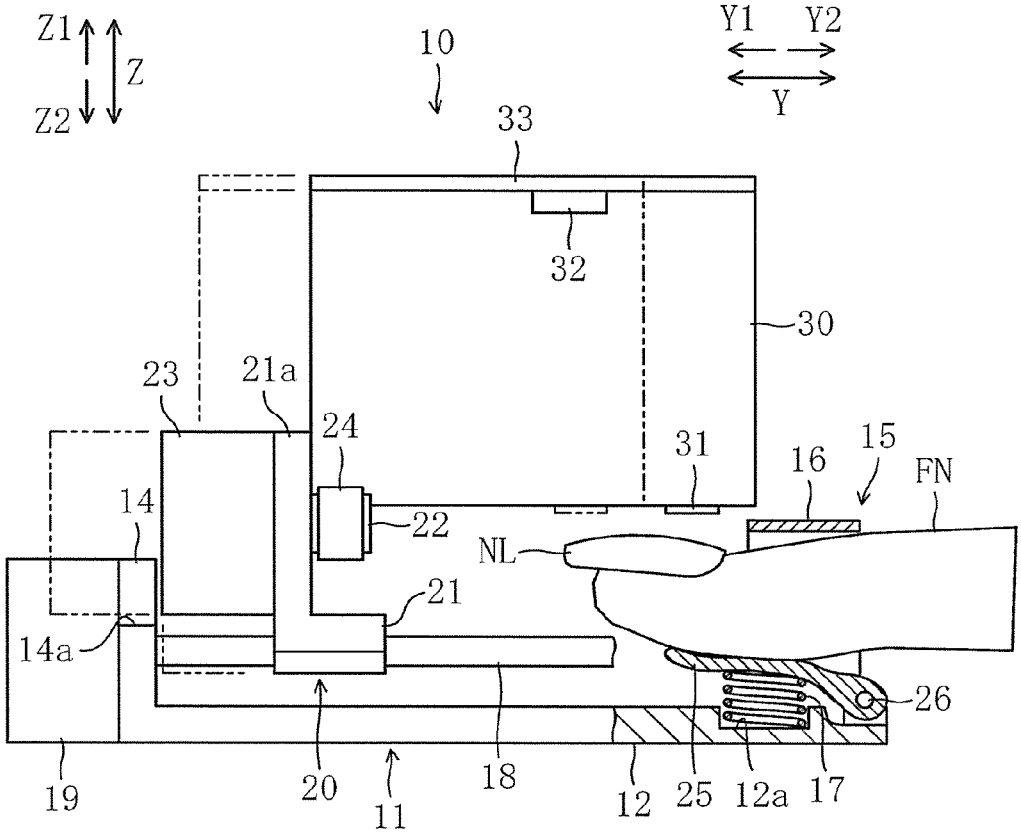
FIG. 3 is a side view showing the configuration of the printer.

As shown in FIG. 1 to FIG. 3, a printer 10 includes a housing part 11 and a scanning part 20, wherein the housing part 11 includes a fixing mechanism 15 for fixing a nail NL of a finger FN that serves as an object at a predetermined position, and the scanning part 20 includes a print head (discharge part) 30 for performing printing on the nail NL of the finger FN fixed at the predetermined position. Moreover, although the first embodiment illustrates a case where the finger of a user serves as the object, the object is not particularly limited and may be things other than the finger.

In this embodiment, when the finger FN is fixed by the fixing mechanism 15, a width direction of the finger FN is an X direction, a direction in which the finger FN extends is a Y direction, and a height direction of the finger FN is a Z direction. In the figures, the X direction, the Y direction, and the Z direction are indicated by arrows. In this embodiment, the X direction is a first direction and the Z direction is a second direction perpendicular to the first direction.

The housing part 11 has a base plate 12, a first side wall 13 erected from an edge on a Y2 side of the base plate 12, and a second side wall 14 erected from an edge on a Y1 side of the base plate 12.

A portion of the first side wall 13 at a substantially central position in the X direction is cut off to form an opening portion 13*a* for inserting the finger FN. The fixing mechanism 15 includes a portal fixing frame 16 disposed to surround the opening part 13*a*, an urging spring 17 disposed on the base plate 12, a placing plate 25 (object placing part) disposed on a Z1 side of the urging spring 17, and a support shaft 26 that extends in the X direction to rotatably support an end of the placing plate 25 on the Y2 side.

The urging spring 17 is fitted into a recess 12*a* formed on the base plate 12 and an end of the urging spring 17 on the Z1 side protrudes from the recess 12*a* and urges the placing plate 25 toward the Z1 side. Here, when the finger FN is inserted through the opening portion 13*a* and placed on the placing plate 25, the placing plate 25 is lifted up by an urging force of the urging spring 17 to urge the finger FN toward the Z1 side. Thereby, the finger FN is sandwiched between the fixing frame 16 and the placing plate 25 and fixed at the predetermined position.

In the housing part 11, two Y-axis motor shafts 18 that extend between the first side wall 13 and the second side wall 14 are disposed in parallel and spaced apart in the X direction. A Y-axis motor 19 is connected with the Y-axis motor shaft 18 on a X1 side. A cut portion 14*a* is formed on an upper part of the second side wall 14 on a X2 side to avoid interference with an X-axis motor 23 (to be described later).

The scanning part 20 includes a scanning table 21 and the print head 30, wherein the scanning table 21 is supported to be movable in the Y direction along the Y-axis motor shaft 18, and the print head 30 is disposed on the scanning table 21.

The scanning table 21 is composed of a plate-like body that has an L-shaped cross section. The plate-like body has a wall portion 21*a* erected from the edge on the Y1 side. A pair of pulleys 22 spaced apart in the X direction is disposed on the wall portion 21*a* of the scanning table 21. The pulley 22 on the X1 side is supported rotatably around an axis in the Y direction that is orthogonal to the wall portion 21*a*. The pulley 22 on the X2 side is connected with the X-axis motor 23. An endless X-axis motor belt 24 is wound on the pair of pulleys 22. The print head 30 is attached to the X-axis motor belt 24.

Here, by driving the X-axis motor 23, a rotational force of the X-axis motor 23 is transmitted to the X-axis motor belt 24 through the pulley 22, and the print head 30 moves in the X direction according to a rotation amount of the X-axis motor belt 24. In addition, by driving the Y-axis motor 19, a rotational force of the Y-axis motor 19 is transmitted to the Y-axis motor shaft 18, such that the print head 30 moves in the Y direction together with the scanning table 21.

Thus, by driving the X-axis motor 23 and the Y-axis motor 19, the print head 30 may be moved along a predetermined scanning direction (the X direction and the Y direction).

The print head 30 includes a nozzle part 31 that discharges ink to the nail NL, and a camera part 32 that captures an image of the nail NL. A camera attaching part 33 is provided on the print head 30 to protrude from an end on the Z1 side toward the X2 side.

The camera part 32 is attached to a surface of the camera attaching part 33 on the Z2 side and is closer to the X2 side than the nozzle part 31. By moving the print head 30 in the X direction, the print head 30 can be switched between a printing position where the nozzle part 31 faces the nail NL to perform printing and an imaging position where the camera part 32 faces the nail NL to capture an image. The image captured by the camera part 32 is inputted to a controller 35.

A range of the nail NL, i.e., a range for printing, for example, is specified by the controller 35 based on the captured image. In addition, the controller 35 controls an operation of the print head 30, so as to print a predetermined nail design on the nail NL.

Specifically, the controller 35 moves the print head 30 along the printing range of the nail NL through control of driving of the X-axis motor 23 and the Y-axis motor 19. Moreover, by controlling to discharge the ink from the nozzle part 31, the ink falls on the nail NL In order to make the ink fall on the correct position on the nail NL of the finger FN, it is necessary to set a distance between the nozzle part 31 of the print head 30 and the nail NL to be very short, e.g., about 1.5 mm.

However, if a fingertip is moved up, the nozzle part 31 of the print head 30 may come into contact with the nail NL.

Therefore, in this embodiment, the configuration is adapted to be able to detect whether the nail NL exists on a movement path of the print head 30 or whether the nail NL is moving toward the movement path of the print head 30.

Figure 4:
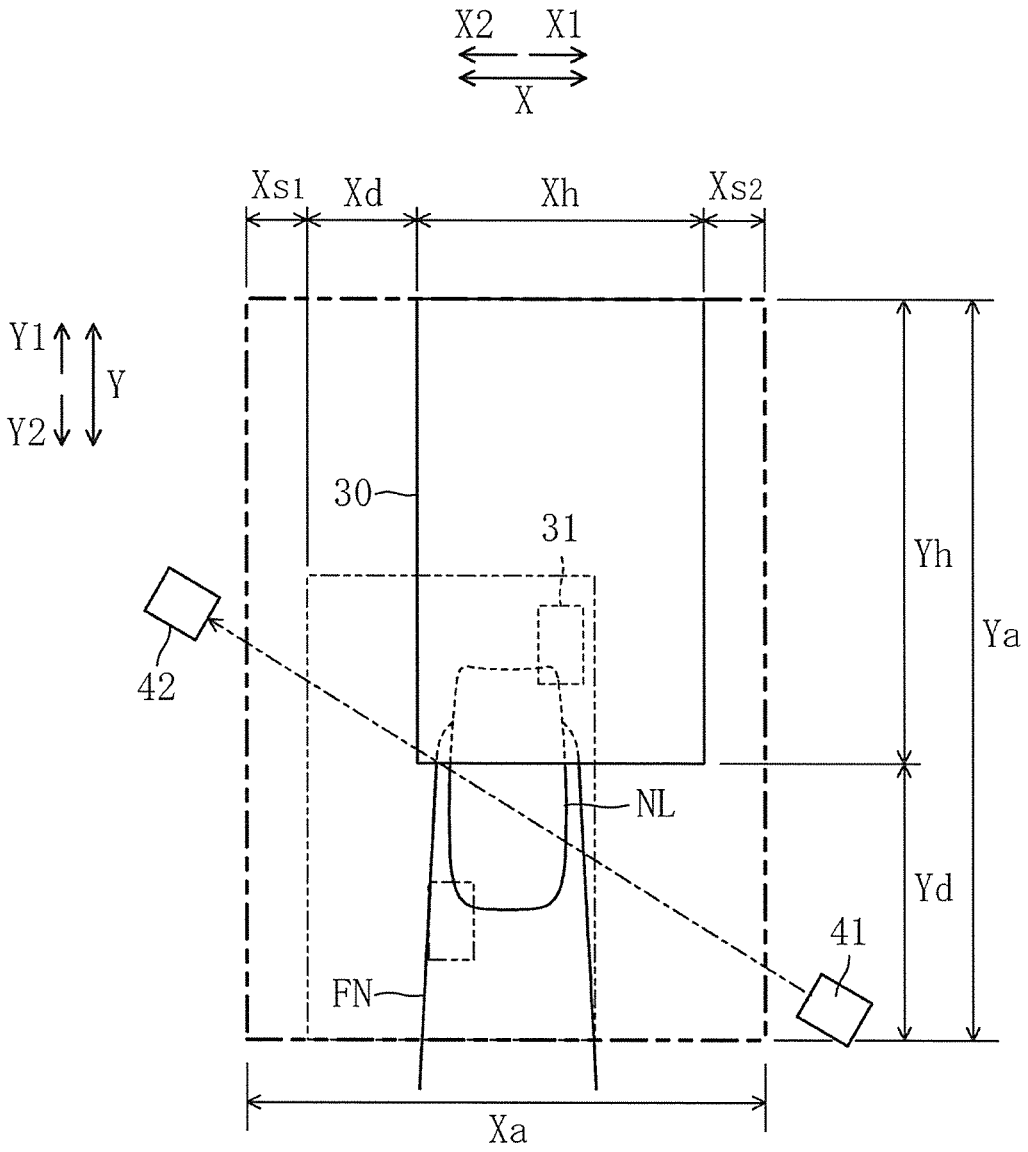
FIG. 4 is a plan view illustrating a light path from a light projecting part to a light receiving part.

As shown in FIG. 4, a light projecting part 41 and a light receiving part 42 are respectively disposed on two sides of the finger FN in the X direction. The light projecting part 41 is disposed on the X1 side and the Y2 side with respect to the finger FN. The light projecting part 41 projects a light having high straightness, such as a laser light, between the nail NL and the print head 30 to form a light path across the nail NL.

The light receiving part 42 is disposed on the X2 side and the Y1 side with respect to the finger FN and receives the light projected by the light projecting part 41. The light receiving part 42 outputs a light receiving signal to the controller 35 while receiving the light.

The light projected by the light projecting part 41 propagates toward the light receiving part 42 in a direction inclined at a predetermined angle with respect to the X direction, i.e., a direction inclined toward the Y1 side. Thereby, the light path across the nail NL is formed.

Here, the light projecting part 41 and the light receiving part 42 are disposed outside the movement range of the print head 30, so as to avoid interfering with the print head 30. Specifically, if a length in the X direction is Xa and a length in the Y direction is Ya, the movement range of the print head 30 is a range defined by Xa×Ya (the range defined by the imaginary lines in FIG. 4).

The length Xa in the X direction is calculated by adding up a length Xh of the print head 30 in the X direction, strokes Xs1 and Xs2 of acceleration and deceleration regions of the print head 30 in the X direction, and a movement distance Xd that the print head 30 moves in the X direction when printing the nail NL.

The strokes Xs1 and Xs2 of the acceleration and deceleration regions refer to distances required for the print head 30 that moves at a high speed in the X direction to reach a constant speed. The movement distance Xd of the print head 30 in the X direction refers to a distance that the nozzle part 31 of the print head 30 indicated by the solid lines in FIG. 4 moves to the position of the nozzle part 31 indicated by the imaginary lines in FIG. 4.

Specifically, an end of the nail NL on the X1 side and the Y1 side is a printing start position of the print head 30 and an end of the nail NL on the X2 side and the Y2 side is a printing end position of the print head 30. Because the print head 30 moves from the printing start position to the printing end position when printing the nail NL, the movement distance Xd of the print head 30 in the X direction is determined.

The length Ya in the Y direction is calculated by adding up a length Yh of the print head 30 in the Y direction and a movement distance Yd that the print head 30 moves in the Y direction when printing the nail NL. The print head 30 does not move at a high speed with respect to the Y direction. Therefore, regarding the Y direction, the strokes of the acceleration and deceleration regions are not taken into account.

The movement distance Yd of the print head 30 in the Y direction refers to a distance that the nozzle part 31 of the print head 30 indicated by the solid lines in FIG. 4 moves to the position of the nozzle part 31 indicated by the imaginary lines in FIG. 4. Because the print head 30 moves from the printing start position to the printing end position when printing the nail NL, the movement distance Yd of the print head 30 in the Y direction is determined.

The light projecting part 41 is disposed on the X1 side with respect to the movement range of the print head 30 in the X direction. The light receiving part 42 is disposed on the side X2 with respect to the movement range of the print head 30 in the X direction. Thereby, when the print head 30 performs printing on the nail NL, the print head 30 and the light projecting part 41 and the light receiving part 42 do not interfere with each other.

Here, if the finger FN is moved up, the light is blocked by the nail NL and the light receiving signal is not outputted from the light receiving part 42. In addition, if a decoration material has been applied on the nail NL, the light may also be blocked by the decoration material.

If the light receiving signal from the light receiving part 42 is not inputted, the controller 35 determines that the nail NL exists on the movement path of the print head 30 and thereby stops driving the print head 30. Specifically, the controller 35 may perform control to stop driving the X-axis motor 23 and the Y-axis motor 19 or perform control to turn off a power supply for a motor driver (not shown). Moreover, at the moment, an error message or the like may be displayed on a display (not shown) to warn the user.

According to this configuration, the print head 30 is prevented from contacting the finger FN, so as to ensure the safety. In addition, contamination of the finger FN or the nail NL and damage of the print head 30 do not occur.

Second Embodiment

Figure 5:
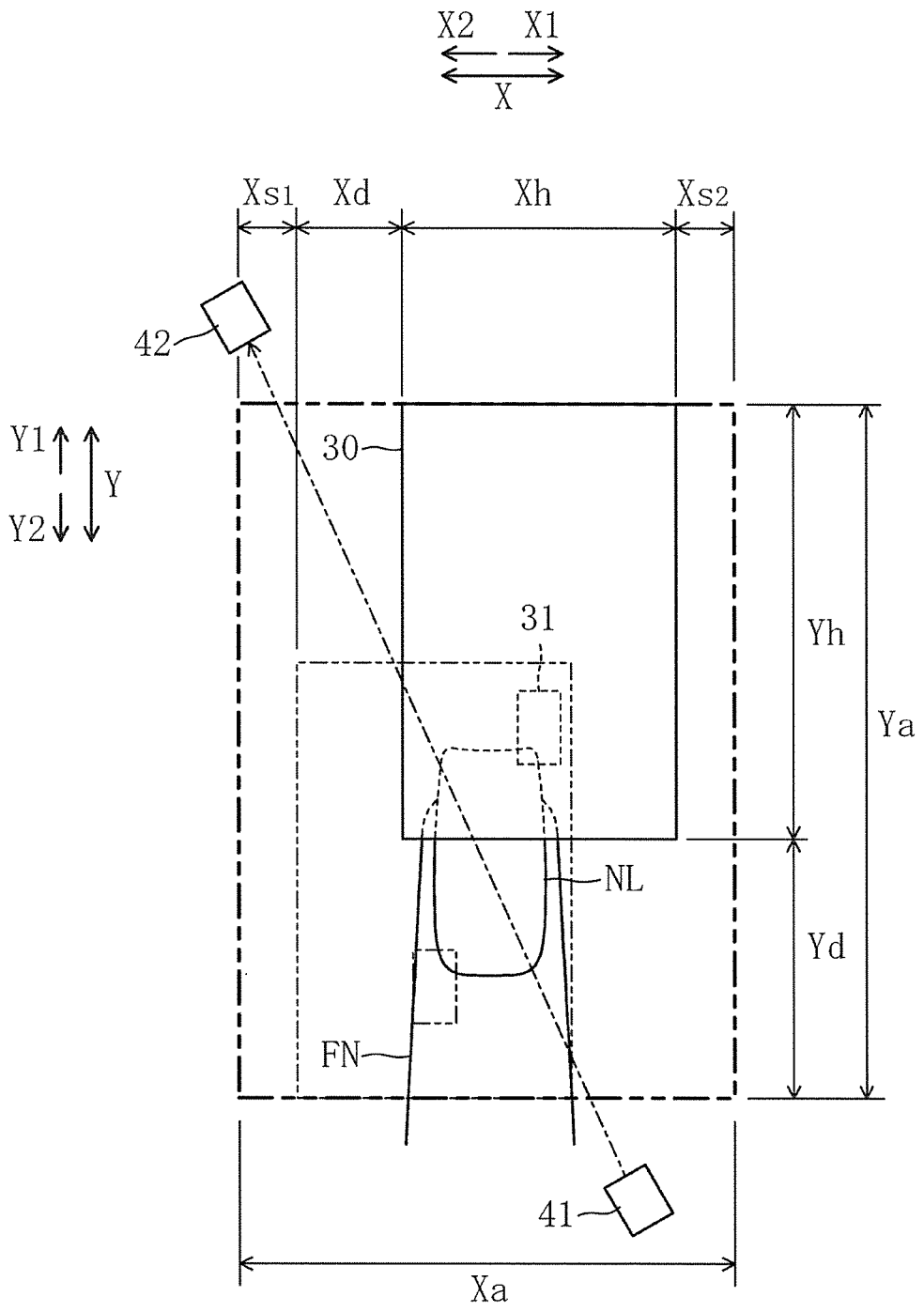
FIG. 5 is a plan view illustrating the light path from the light projecting part to the light receiving part according to the second embodiment.

FIG. 5 is a plan view illustrating the light path from the light projecting part to the light receiving part according to the second embodiment. Parts the same as those of the first embodiment are assigned with the same reference numerals and only the differences are described hereinafter. Moreover, although the second embodiment illustrates a case where the finger of the user serves as the object, the object is not particularly limited and may be things other than the finger.

As shown in FIG. 5, the light projecting part 41 and the light receiving part 42 are respectively disposed on two sides of the finger FN in the X direction. The light projecting part 41 is disposed on the X1 side and the Y2 side with respect to the finger FN. The light receiving part 42 is disposed on the X2 side and the Y1 side with respect to the finger FN.

Here, the light projecting part 41 and the light receiving part 42 are disposed outside the movement range of the print head 30, so as to avoid interfering with the print head 30. Specifically, if the length in the X direction is Xa and the length in the Y direction is Ya, the movement range of the print head 30 is a range defined by Xa×Ya (the range defined by the imaginary lines in FIG. 5).

The light projecting part 41 is disposed on the Y2 side with respect to the movement range of the print head 30 in the Y direction. The light receiving part 42 is disposed on the Y1 side with respect to the movement range of the print head 30 in the Y direction. Thereby, when the print head 30 performs printing on the nail NL, the print head 30 and the light projecting part 41 and the light receiving part 42 do not interfere with each other.

Third Embodiment

Figure 6:
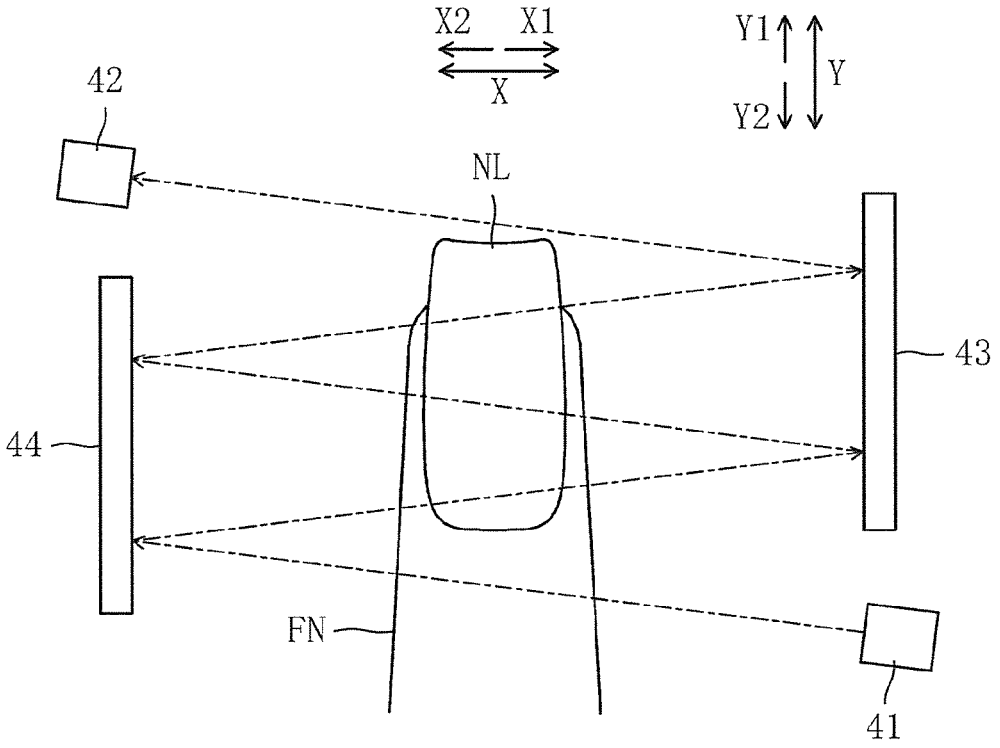
FIG. 6 is a plan view illustrating the light path from the light projecting part to the light receiving part according to the third embodiment.

FIG. 6 is a plan view illustrating the light path from the light projecting part to the light receiving part according to the third embodiment. Parts the same as those of the first embodiment are assigned with the same reference numerals and only the differences are described hereinafter. Moreover, although the third embodiment illustrates a case where the finger of the user serves as the object, the object is not particularly limited and may be things other than the finger.

As shown in FIG. 6, a pair of reflecting mirrors 43 and 44 is respectively disposed on two sides of the finger FN in the X direction to serve as a reflecting part for reflecting the light. The light projecting part 41 is disposed on the Y2 side with respect to the reflecting mirror 43 on the X1 side. The light receiving part 42 is disposed on the Y1 side with respect to the reflecting mirror 44 on the side X2. Nevertheless, this arrangement of the light projecting part 41 and the light receiving part 42 is merely an example, and the invention is not limited to this form.

The light projected by the light projecting part 41 propagates toward the reflecting mirror 44 on the X2 side in a direction inclined at a predetermined angle with respect to the X direction, i.e., a direction inclined toward the Y1 side.

The light propagating across the nail NL is reflected by the reflecting mirror 44 on the X2 side to be turned toward the reflecting mirror 43 on the X1 side. Thus, the light is reflected between the pair of reflecting mirrors 43 and 44 to form the light path that is turned multiple times in the X direction of the finger FN.

In the example shown in FIG. 6, the light projected by the light projecting part 41 is turned two times respectively by the reflecting mirrors 43 and 44 on the X1 side and the X2 side and then received by the light receiving part 42. Nevertheless, the number of times that the light path is turned is merely an example, and the invention is not limited to this form.

According to this configuration, the nail NL may be detected over the entire range of the nail NL in the Y direction, and the detection performance is enhanced to improve the safety.

Fourth Embodiment

Figure 7:
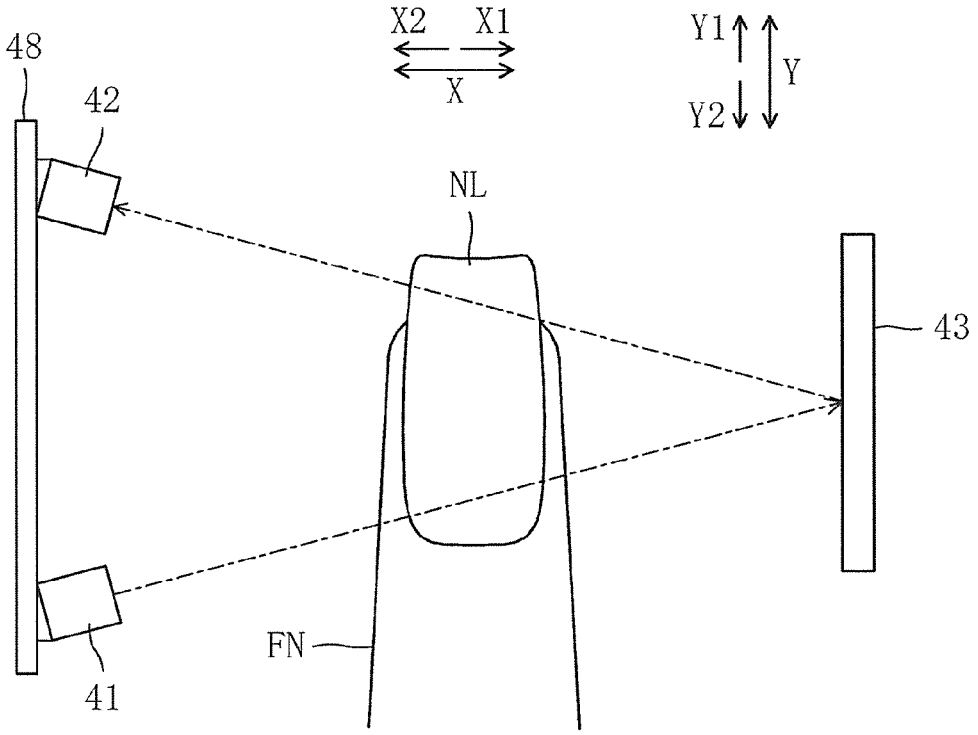
FIG. 7 is a plan view illustrating the light path from the light projecting part to the light receiving part according to the fourth embodiment.

FIG. 7 is a plan view illustrating the light path from the light projecting part to the light receiving part according to the fourth embodiment. Parts the same as those of the first embodiment are assigned with the same reference numerals and only the differences are described hereinafter. Moreover, although the fourth embodiment illustrates a case where the finger of the user serves as the object, the object is not particularly limited and may be things other than the finger.

As shown in FIG. 7, the reflecting mirror 43 is disposed on the X1 side with respect to the finger FN to serve as the reflecting part for reflecting the light. The light projecting part 41 and the light receiving part 42 are disposed on the X2 side with respect to the finger FN. The light receiving part 42 is disposed on the Y1 side with respect to the light projecting part 41. The light projecting part 41 and the light receiving part 42 are mounted on a printed board (substrate) 48.

The light projected by the light projecting part 41 across the nail NL of the finger FN is reflected by the reflecting mirror 43 to be turned toward the light receiving part 42.

According to this configuration, the light projecting part 41 and the light receiving part 42 are both disposed on the X2 side of the finger FN, such that the light projecting part 41 and the light receiving part 42 may be mounted on the one printed board (substrate) 48, which includes a circuit and still has a simple structure.

Fifth Embodiment

Figure 8:
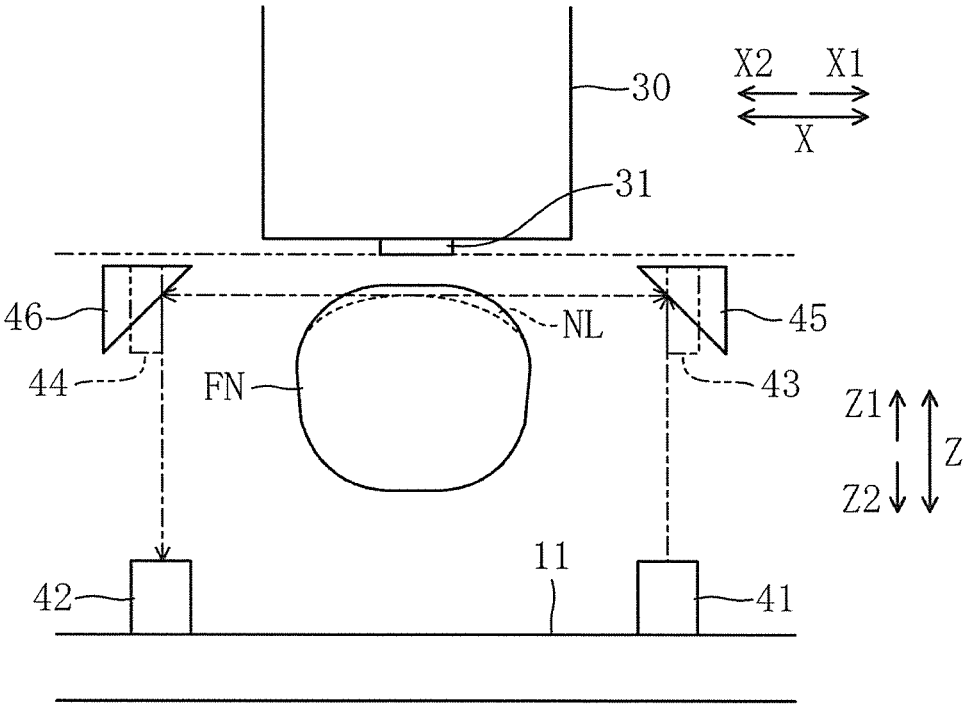
FIG. 8 is a front view illustrating the light path from the light projecting part to the light receiving part according to the fifth embodiment.
Figure 9:
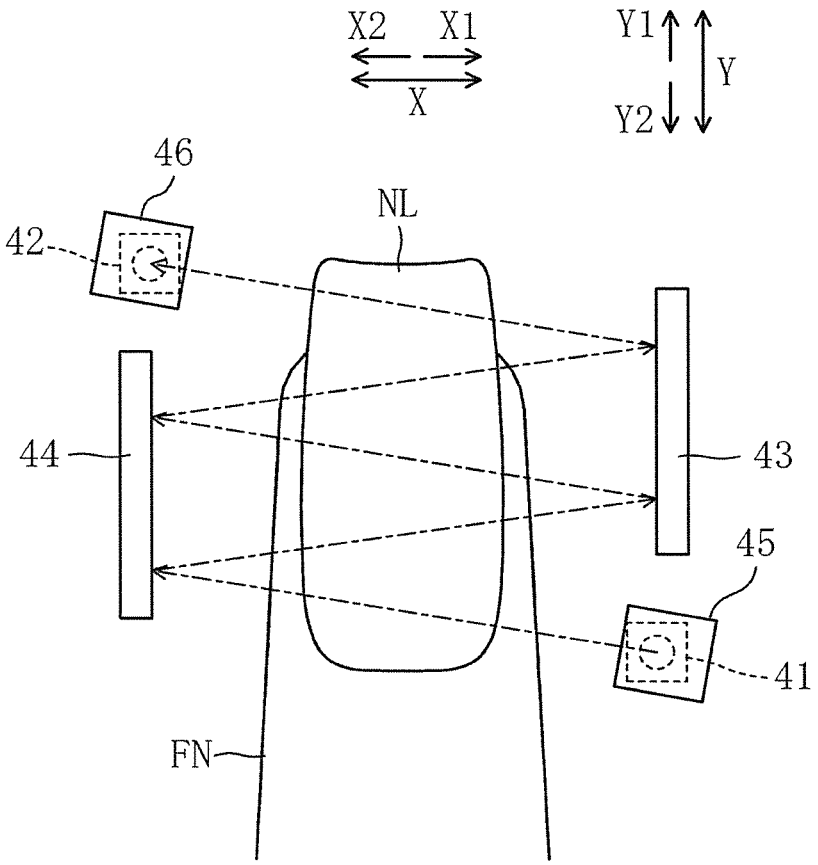
FIG. 9 is a plan view illustrating the light path from the light projecting part to the light receiving part.

FIG. 8 is a front view illustrating the light path from the light projecting part to the light receiving part according to the fifth embodiment, and FIG. 9 is a plan view. Parts the same as those of the first embodiment are assigned with the same reference numerals and only the differences are described hereinafter. Moreover, although the fifth embodiment illustrates a case where the finger of the user serves as the object, the object is not particularly limited and may be things other than the finger.

As shown in FIG. 8 and FIG. 9, the pair of reflecting mirrors 43 and 44 for reflecting the light is respectively disposed on two sides of the finger FN in the X direction. The light is reflected between the reflecting mirrors 43 and 44 to form the light path that is turned multiple times in the X direction of the finger FN. In order to avoid interference with the nozzle part 31 of the print head 30, the ends of the reflecting mirrors 43 and 44 on the Z1 side are disposed on the Z2 side with respect to the nozzle part 31.

A light projecting side guiding mirror 45 is disposed on the Y2 side with respect to the reflecting mirror 43 on the side X1 to serve as a light projecting side guiding part. The light projecting part 41 is disposed on the Z2 side with respect to the light projecting side guiding mirror 45. A light receiving side guiding mirror 46 is disposed on the Y1 side with respect to the reflecting mirror 44 on the X2 side to serve as a light receiving side guiding part. The light receiving part 42 is disposed on the Z2 side with respect to the light receiving side guiding mirror 46. Thus, the light projecting part 41 and the light receiving part 42 are directed in the Z2 direction from the nail NL and disposed at separated positions. Nevertheless, this arrangement of the light projecting part 41 and the light receiving part 42 is merely an example, and the invention is not limited to this form.

The light projecting side guiding mirror 45 is a mirror having a triangular cross-sectional shape and having a reflecting surface for reflecting the light that is projected to the Z1 side from the light projecting part 41 to the X2 side. The light receiving side guiding mirror 46 is a mirror having a triangular cross-sectional shape and having a reflecting surface for reflecting the light that propagates to the X2 side to the Z2 side.

In order to avoid interference with the nozzle part 31 of the print head 30, ends of the light projecting side guiding mirror 45 and the light receiving side guiding mirror 46 on the Z1 side are disposed on the Z2 side with respect to the nozzle part 31.

The light projecting side guiding mirror 45 reflects the light projected to the Z1 side from the light projecting part 41 to the X2 side to guide the light across the nail NL. The light receiving side guiding mirror 46 reflects the light that propagates to the X2 side across the nail NL to the Z2 side to guide the light to the light receiving part 42.

In the example shown in FIG. 9, the light projected by the light projecting part 41 is reflected by the light projecting side guiding mirror 45 to be guided to propagates across the nail NL. The light that propagates across the nail NL is turned two times respectively by the reflecting mirrors 43 and 44 on the X1 side and the X2 side, reflected by the light receiving side guiding mirror 46 and guided to the light receiving part 42, and then received by the light receiving part 42. Nevertheless, the number of times that the light path is turned is merely an example, and the invention is not limited to this form.

According to this configuration, the arrangement and positions of the light projecting part 41 and the light receiving part 42 may be set at will when forming the light path between the nail NL and the print head 30. That is, the light projecting part 41 and the light receiving part 42 may be disposed near the finger FN without considering the movement range of the print head 30, and the design may be made to meet needs such as miniaturization of the device.

Sixth Embodiment

Figure 10:
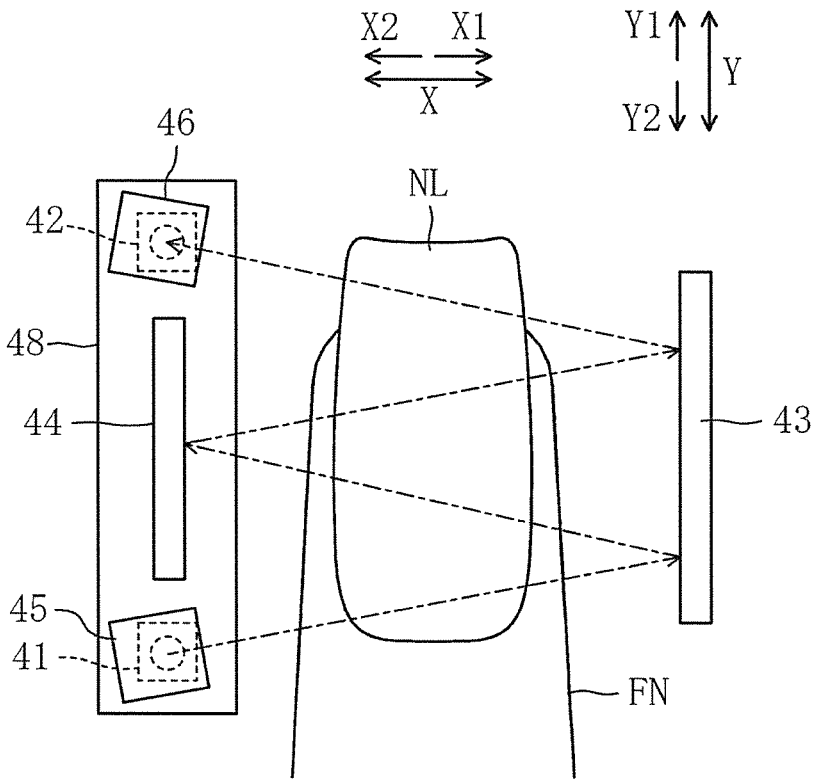
FIG. 10 is a plan view illustrating the light path from the light projecting part to the light receiving part according to the sixth embodiment.

FIG. 10 is a plan view illustrating the light path from the light projecting part to the light receiving part according to the sixth embodiment. Parts the same as those of the fifth embodiment are assigned with the same reference numerals and only the differences are described hereinafter. Moreover, although the sixth embodiment illustrates a case where the finger of the user serves as the object, the object is not particularly limited and may be things other than the finger.

As shown in FIG. 10, the pair of reflecting mirrors 43 and 44 for reflecting the light is respectively disposed on two sides of the finger FN in the X direction. The light is reflected between the reflecting mirrors 43 and 44 to form the light path that is turned multiple times in the X direction of the finger FN.

The light projecting part 41 and the light receiving part 42 are disposed on the X2 side with respect to the finger FN. The light projecting part 41 is disposed on the Y2 side with respect to the reflecting mirror 44 on the X2 side. The light receiving part 42 is disposed on the Y1 side with respect to the reflecting mirror 44 on the X2 side. The light projecting part 41 and the light receiving part 42 are mounted on a printed board (substrate) 48.

The light projected by the light projecting part 41 is reflected by the reflecting mirror 43 on the X1 side to be turned toward the reflecting mirror 44 on the X2 side. Thus, the light is reflected between the pair of reflecting mirrors 43 and 44 to form the light path that is turned multiple times in the X direction of the finger FN.

In the example shown in FIG. 10, the light projected by the light projecting part 41 is turned two times by the reflecting mirror 43 on the X1 side and turned one time by the reflecting mirror 44 on the X2 side and then received by the light receiving part 42. Nevertheless, the number of times that the light path is turned is merely an example, and the invention is not limited to this form.

According to this configuration, the light projecting part 41 and the light receiving part 42 are both disposed on the X2 side of the finger FN, such that the light projecting part 41 and the light receiving part 42 may be mounted on the one printed substrate 48, which includes a circuit and still has a simple structure.

Seventh Embodiment

Figure 11:
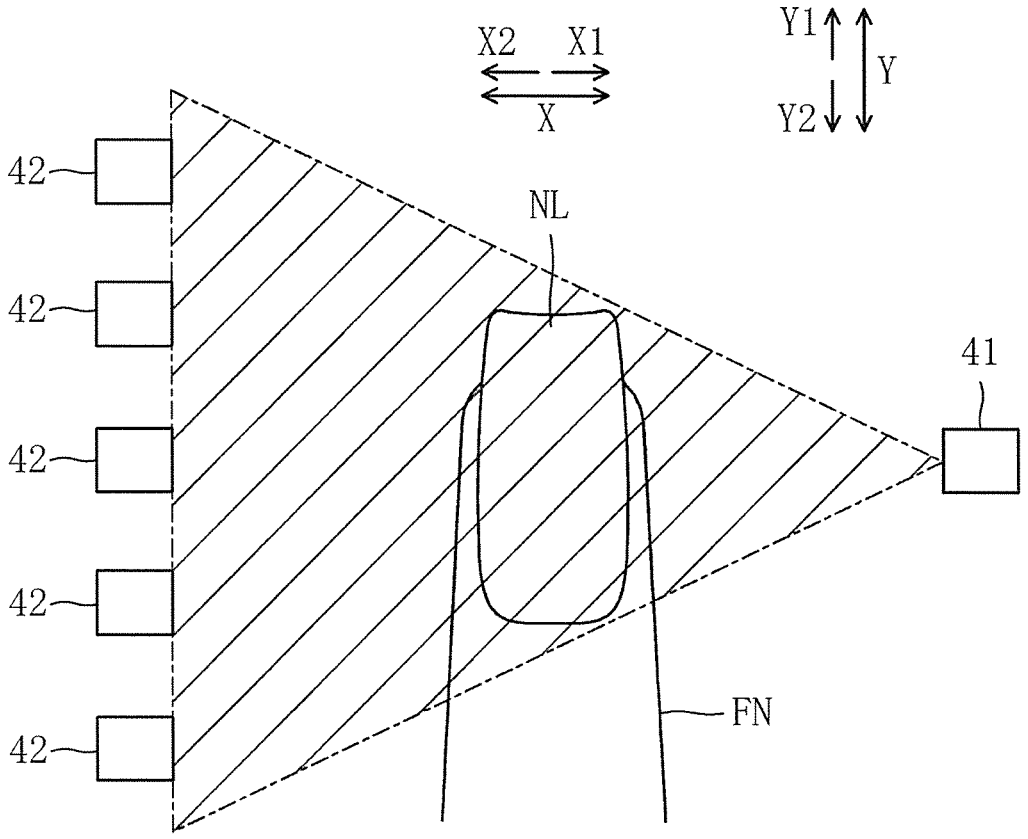
FIG. 11 is a plan view illustrating the light path from the light projecting part to the light receiving part according to the seventh embodiment.

FIG. 11 is a plan view illustrating the light path from the light projecting part to the light receiving part according to the seventh embodiment. Parts the same as those of the first embodiment are assigned with the same reference numerals and only the differences are described hereinafter. Moreover, although the seventh embodiment illustrates a case where the finger of the user serves as the object, the object is not particularly limited and may be things other than the finger.

As shown in FIG. 11, the light projecting part 41 is disposed on the X1 side with respect to the finger FN. The light projecting part 41 is constituted by a line laser light source and projects a laser light that spreads radially between the nail NL and the print head 30, so as to form a light path across the entire range of the nail NL in the Y direction.

A plurality of the light receiving parts 42 are disposed at an interval in the Y direction on the X2 side with respect to the finger FN (five are shown in the example of FIG. 11). The radially spreading laser light projected by the light projecting part 41 is received by the light receiving parts 42 after propagating across the entire range of the nail NL in the Y direction.

According to this configuration, the nail NL may be detected over the entire range of the nail NL in the Y direction, and the detection performance is enhanced to improve the safety.

Eighth Embodiment

Figure 12:
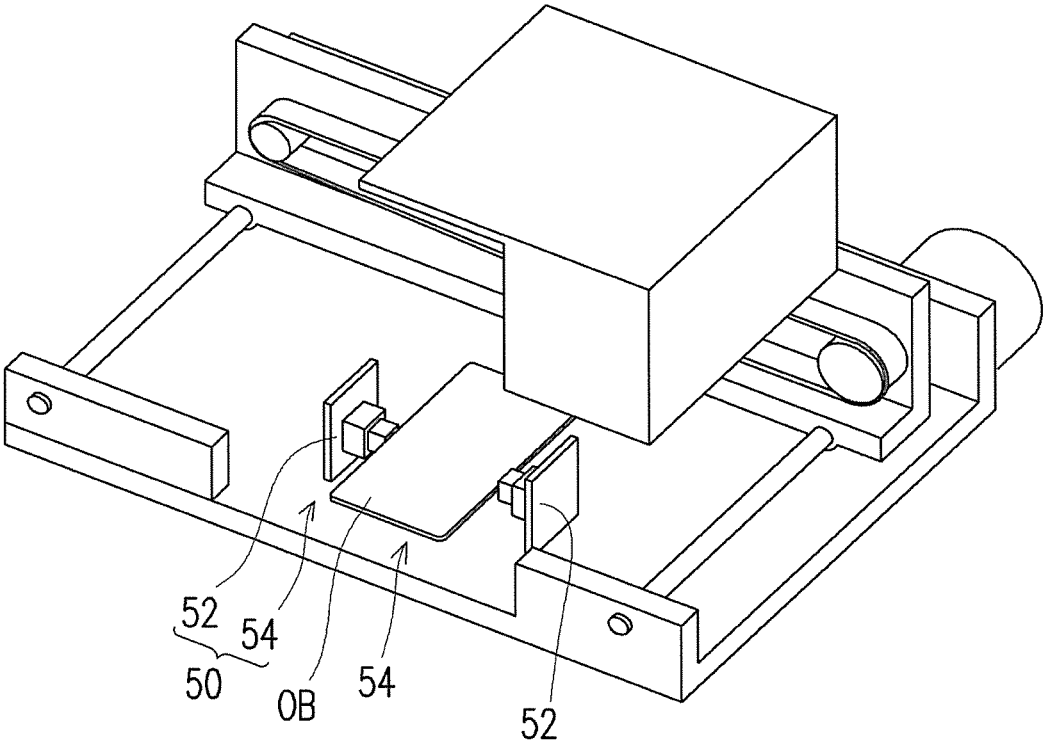
FIG. 12 is a perspective view showing the configuration of a printer according to the eighth embodiment.
Figure 13:
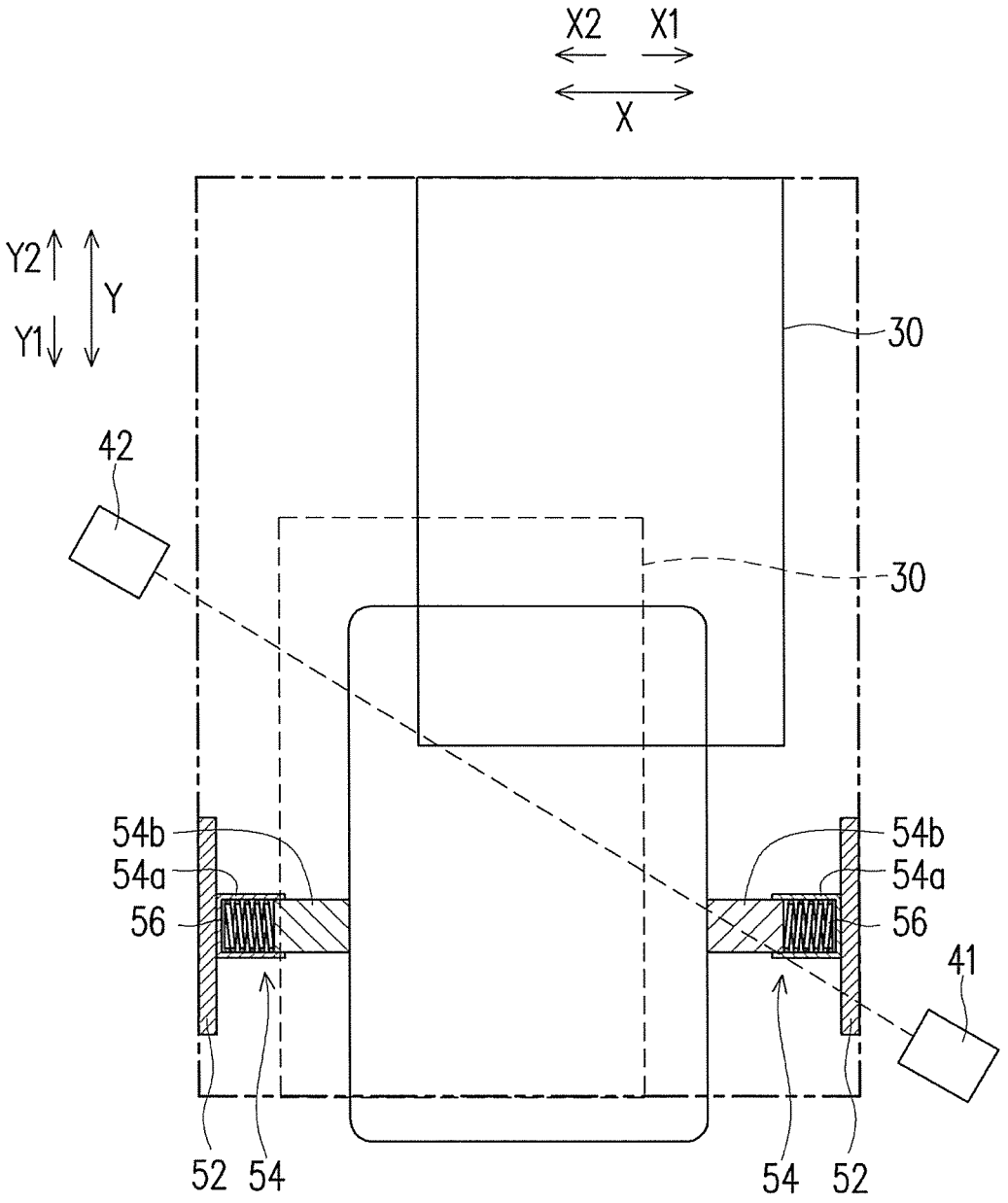
FIG. 13 is a plan view illustrating the light path from the light projecting part to the light receiving part according to the eighth embodiment.
Figure 14:
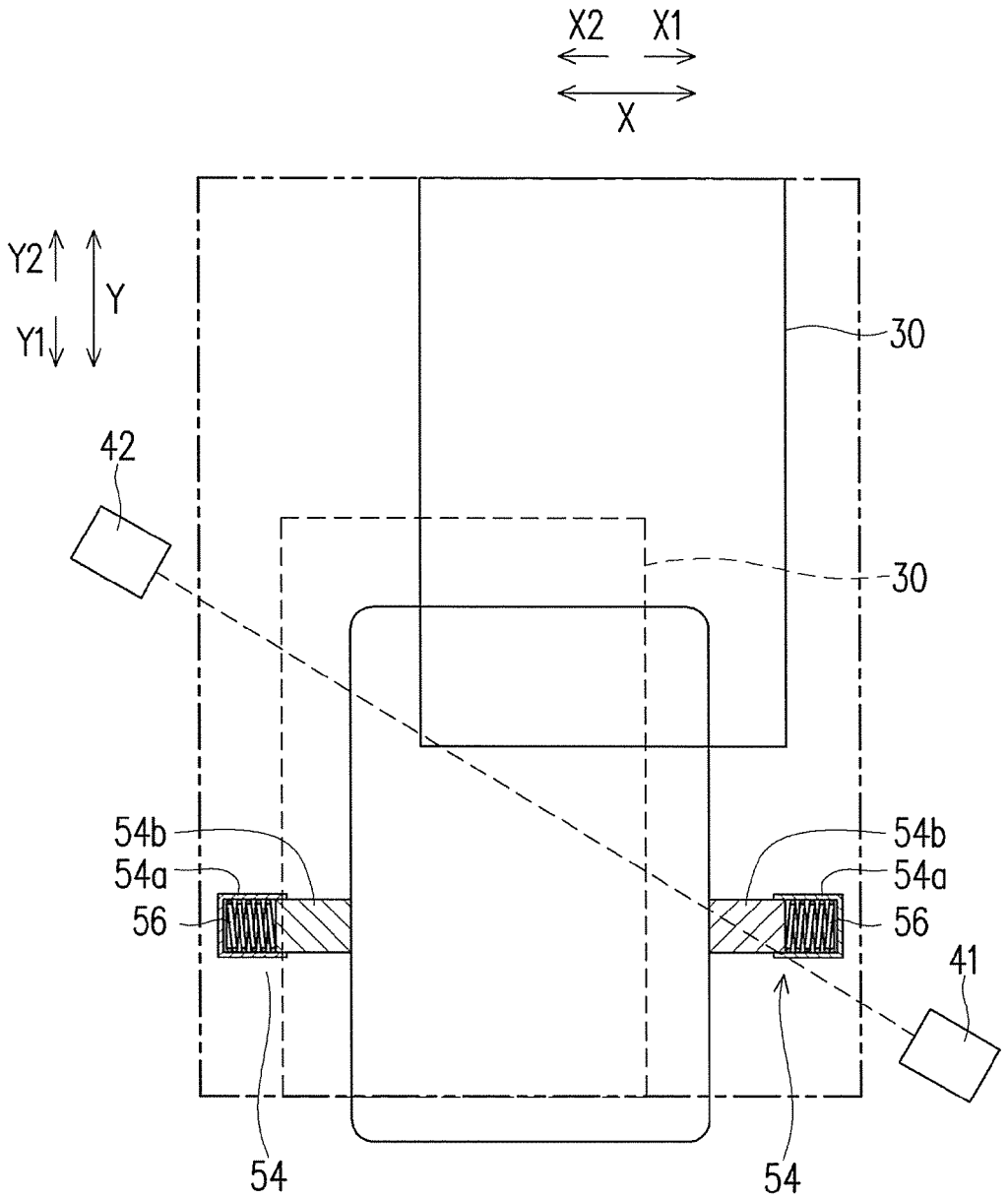
FIG. 14 is a plan view illustrating the light path from the light projecting part to the light receiving part according to a variation of the eighth embodiment.

FIG. 12 is a perspective view showing the configuration of a printer according to the eighth embodiment. FIG. 13 is a plan view illustrating the light path from the light projecting part to the light receiving part according to the eighth embodiment. FIG. 14 is a plan view illustrating the light path from the light projecting part to the light receiving part according to a variation of the eighth embodiment. Parts the same as those of the first embodiment are assigned with the same reference numerals and only the differences are described hereinafter.

Figure 15:
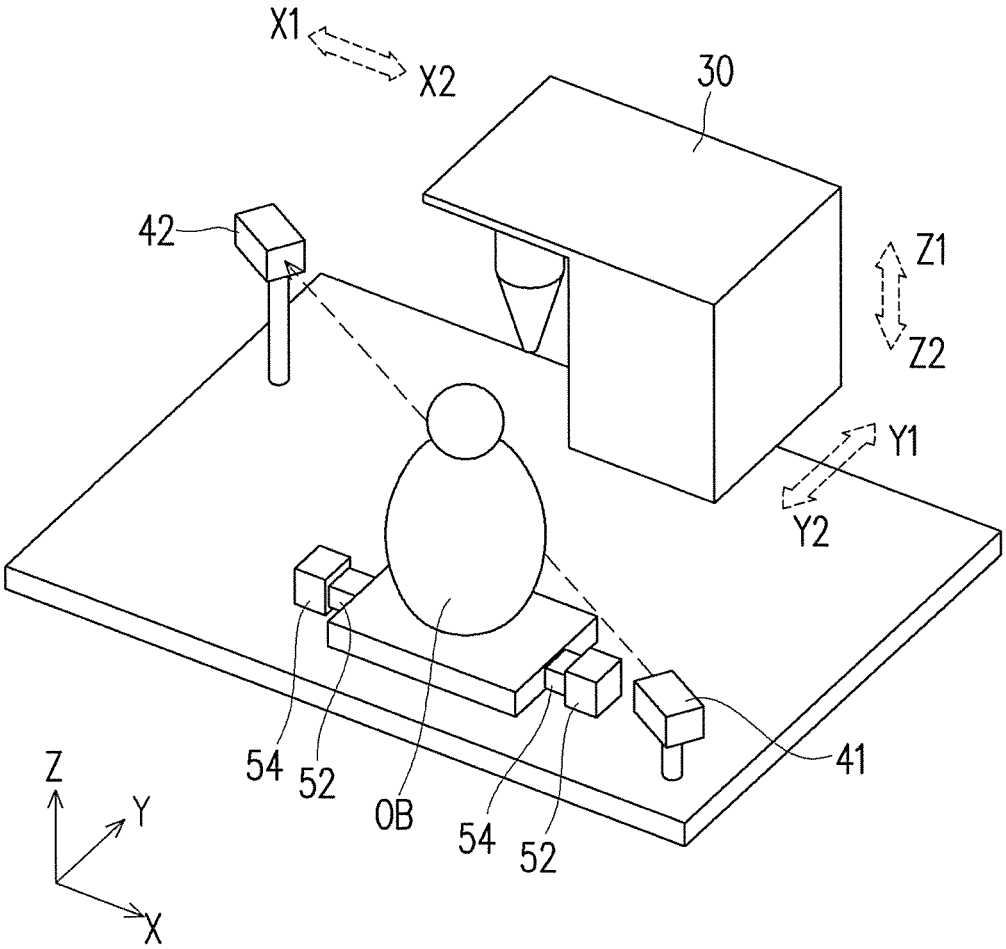
FIG. 15 is a perspective view showing the schematic configuration of a printer according to the ninth embodiment.

A difference between the eighth embodiment and the first embodiment lies in the fixing mechanism for an object OB, which is somewhat adjusted to be applied to the object OB that is other than the finger. Nevertheless, what illustrated here is merely an example, and those skilled in the art may make appropriate adjustments or changes according to the practical application. As shown in FIG. 13, fixing mechanisms 50, for example, include a pair of wall plates 52 disposed in parallel and a pair of positioning parts 54 respectively disposed on the wallplates 52 and used to hold the object OB from the left and right (the X direction in the figure) of the object OB. FIG. 15 illustrates another fixing method. As shown in FIG. 15, the fixing mechanisms 50 only include the pair of positioning parts 54 that is directly disposed on the base plate 12.

As shown in FIG. 13 or FIG. 14, the pair of positioning parts 54 respectively includes a main body 54*a*, an urging member 56, and a holding member 54*b*, for example. The main body 54*a* may be fixed to an inner wall surface of the wallplate 52 at a predetermined height. The urging member 56 (a compression spring in this embodiment, for example) is disposed in the main body 54*a* with an end in contact with the holding member 54*b*. A front end of the holding part 54*b* is used for fixing the object OB. When the printing object OB is placed between the pair of positioning parts 54, the holding member 54*b* press down the compression spring, and by an urging force of the compression spring, fix the object OB. In this state, the print head 30 operates to apply printing on the object OB.

As shown in FIG. 13 or FIG. 14, the light projecting part 41 and the light receiving part 42 are respectively disposed on two sides of the object OB in the X direction. The light projecting part 41 and the light receiving part 42 have an arrangement similar to FIG. 4, and when the print head 30 performs printing on the object OB, the print head 30 and the light projecting part 41 and the light receiving part 42 do not interfere with each other.

Thereby, the light projecting part 41 projects a light having high straightness, such as a laser light, between the object OB and the print head 30 to form the light path across the object OB. The light projected by the light projecting part 41 propagates toward the light receiving part 42 in a direction inclined at a predetermined angle with respect to the X direction, i.e., a direction inclined toward the Y1 side. Furthermore, the light receiving part 42 receives the light projected by the light projecting part 41. The light receiving part 42 outputs a light receiving signal to the controller 35 (not shown here, please refer to the example of FIG. 2) while receiving the light.

Movement of the printing object OB due to factors such as external influences may result in damage of the print head 30. Therefore, when the object OB moves, for example, when the object OB moves upward, the laser light projected by the light projecting part 41 is blocked by the object OB or a surface protrusion (e.g., decoration material) on the object OB, during which the light receiving part 42 does not receive the laser light from the light projecting part 41. The controller 35 determines that the object OB exists on the movement path of the print head 30 and stops driving the print head 30. Specifically, the controller 35 may perform control to stop driving the X-axis motor 23 and the Y-axis motor 19 or perform control to turn off a power supply for a motor driver (not shown). Moreover, at the moment, an error message or the like may be displayed on a display (not shown) to warn the user.

According to this configuration, the print head 30 is prevented from contacting the object OB, so as to ensure the safety. In addition, contamination of the object OB and damage of the print head 30 do not occur.

Additionally, in the eighth embodiment and its variation shown in FIG. 13 and FIG. 14, an arrangement method of the light projecting part 41 and the light receiving part 42 is described based on the arrangement method shown in FIG.

4. Of course, the arrangement methods shown in the second to the seventh embodiments of FIG. 5 to FIG. 11 may also be applied to the printer of the eighth embodiment shown in FIG. 12. Under the circumstances, the arrangement method and operation of the light projecting part 41 and the light receiving part 42 are similar to the disclosure of FIG. 5 to FIG. 11 and thus descriptions thereof are omitted.

Ninth Embodiment

Figure 16:
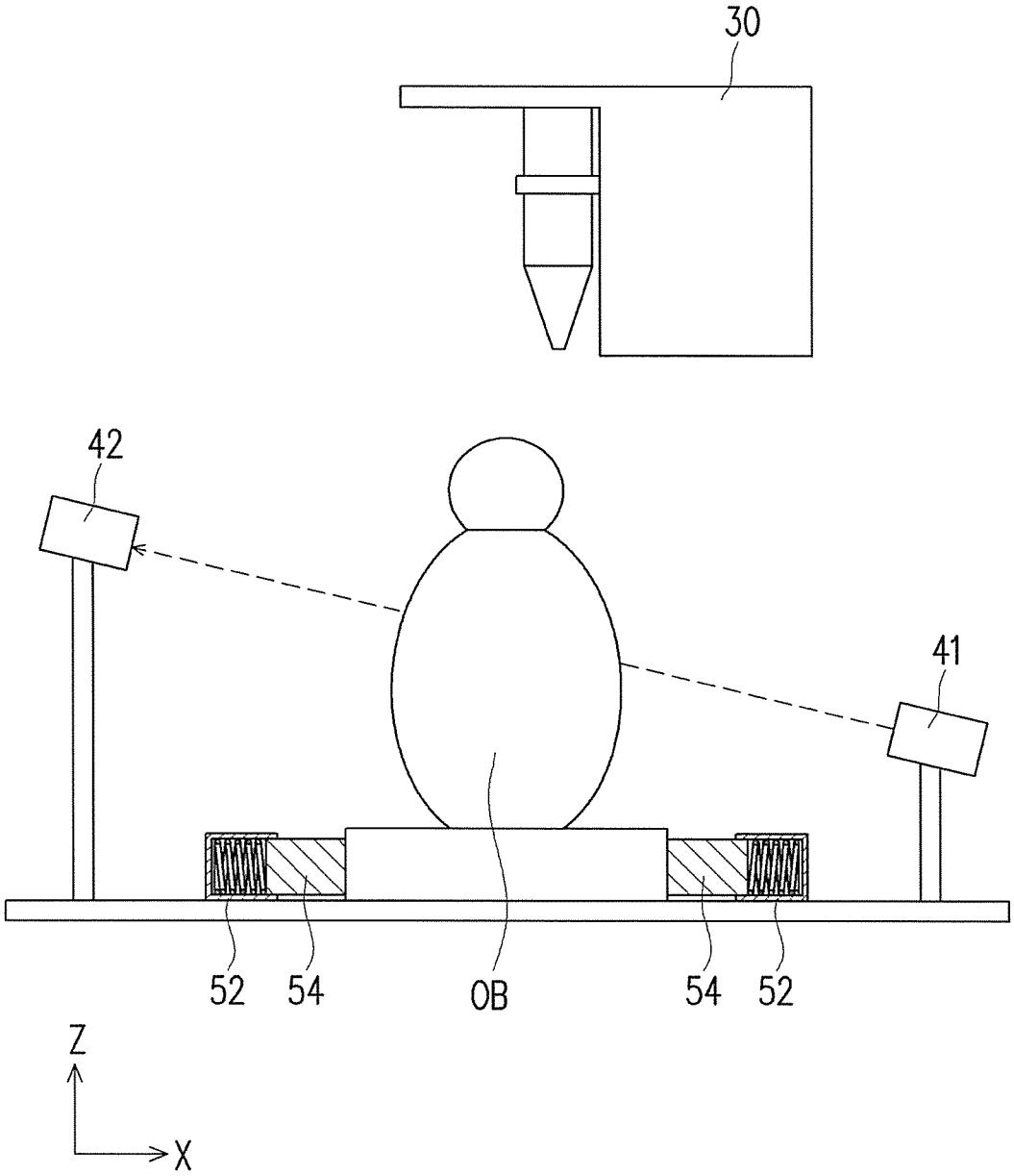
FIG. 16 is a plan view (ZX plane) showing the schematic configuration of the printer according to the ninth embodiment.

FIG. 15 is a perspective view showing the schematic configuration of a printer according to the ninth embodiment. FIG. 16 is a plan view (ZX plane) showing the schematic configuration of the printer according to the ninth embodiment. In the ninth embodiment, a 3D printer used for surface printing of a three-dimensional object OB is depicted. For simplicity, FIG. 15 to FIG. 16 only illustrate that the print head 30 is capable of moving in three directions, i.e., XYZ axes, and the X-axis motor 23, the Y-axis motor 19, the X-axis motor belt 24, the Y-axis motor shaft 18, and so on described in the first to the seventh embodiments are omitted. In the eighth embodiment, a set of a Z-axis motor and a Z-axis motor shaft, or the Z-axis motor and a Z-axis motor belt are added for moving the print head 30 in the Z axis direction. With the three sets (X, Y, and Z axes) of motors, the print head 30 of the printer 10 is able to move in the XYZ axes to perform printing on the surface of the three-dimensional object OB.

Like the eighth embodiment, the light projecting part 41 and the light receiving part 42 are disposed, as shown in FIG. 15 to FIG. 16, in order to detect whether the object OB enters the movement path of the print head 30. As described above, the light projecting part 41 emits a laser light to be received by the light receiving part 42. The laser light propagates between the print head 30 and the object OB. Because the object OB itself is in a three-dimensional shape, the light projecting part 41 and the light receiving part 42 may have various forms in comparison with the first to the seventh embodiments. In the arrangement example of this embodiment, the light projected by the light projecting part 41 is across a portion which protrudes most among cross-sectional profiles of the object OB in parallel to the XY plane. Those skilled in the art may adjust the light projecting part 41 and the light receiving part 42 to optimal positions according to the actual needs.

As described with reference to FIG. 4, an arrangement area for the light projecting part 41 and the light receiving part 42 shown in FIG. 15 to FIG. 16 is also outside the movement range of the print head 30 in the X, Y, and Z directions. In this embodiment, the light projecting part 41 is disposed in an X1 direction, a Y2 direction, and a Z2 direction outside the movement range of the print head 30. The light receiving part 42 is disposed in an X2 direction, a Y1 direction, and a Z1 direction outside the movement range of the print head 30.

If the object OB moves or tilts due to factors such as external influences, the object OB may enter the movement path of the print head 30 and cause damage to the print head 30. Therefore, when the object OB moves or tilts, for example, when the object OB falls down, the laser light projected by the light projecting part 41 may be blocked by the object OB or a surface protrusion (e.g., decoration material) on the object OB, and at the moment, the light receiving part 42 does not receive the laser light from the light projecting part 41. Meanwhile, the controller 35 (not shown here, please refer to the arrangement example shown in FIG. 2) determines that the object OB exists on the movement path of the print head 30 and stops driving the print head 30. Specifically, the controller 35 may perform control to stop driving the X-axis motor, the Y-axis motor, and the Z-axis motor, or perform control to turn off the power supply for a motor driver (not shown). Moreover, at the moment, an error message or the like may be displayed on a display part (not shown) to warn the user.

Figure 17:
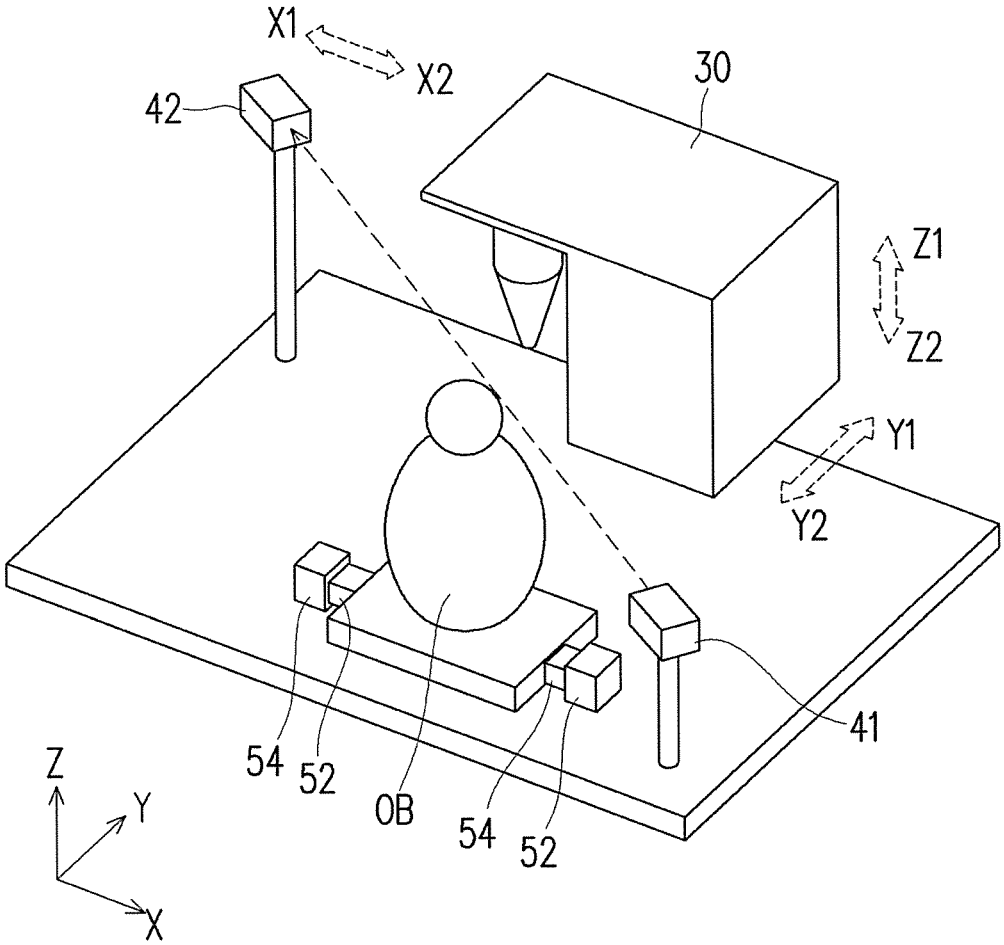
FIG. 17 is a perspective view showing the schematic configuration of the printer according to a variation of the ninth embodiment.
Figure 18:
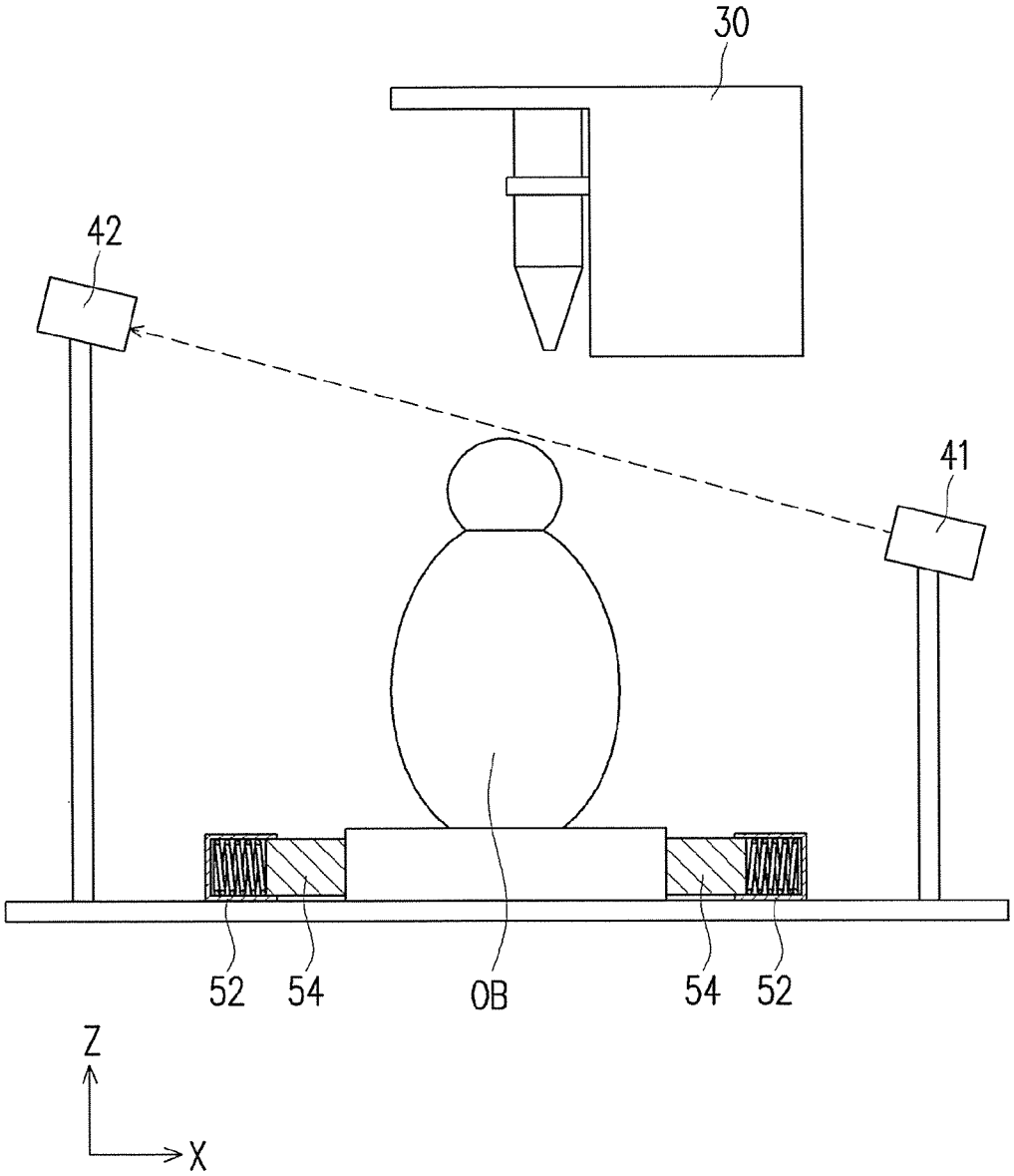
FIG. 18 is a plan view (ZX plane) showing the schematic configuration of the printer according to a variation of the ninth embodiment.

FIG. 17 is a perspective view showing the schematic configuration of a printer according to a variation of the ninth embodiment. FIG. 18 is a plan view (ZX plane) showing the schematic configuration of a printer according to a variation of the ninth embodiment. In this example, mainly, whether a highest position of the object OB exists on the movement path of the print head 30 is detected. In this case, as shown in FIG. 17 to FIG. 18, the light projecting part 41 and the light receiving part 42 may be disposed such that the laser light projected by the light projecting part 41 propagates across the highest position of the object OB and the print head 30 to be received by the light receiving part 42.

In this embodiment, the light projecting part 41 and the light receiving part 42 are disposed such that the light projected by the light projecting part 41 propagates across the highest position of the object OB in the height direction (the Z direction). Thereby, whether the highest position of the object OB exists on the movement path of the print head 30 is determined. Nevertheless, those skilled in the art may adjust the light projecting part 41 and the light receiving part 42 to optimal positions according to actual needs.

According to this configuration, the print head 30 is prevented from contacting the object OB, so as to ensure the safety. In addition, contamination of the object OB and damage of the print head 30 do not occur.

Additionally, in the ninth embodiment and its variation shown in FIG. 15 to FIG. 18, an arrangement method of the light projecting part 41 and the light receiving part 42 is described based on a variation of the arrangement method of FIG. 4. Of course, the arrangement methods shown in the second to the seventh embodiments of FIG. 5 to FIG. 11 may also be applied to the printer of the ninth embodiment shown in FIGS. 15 to 18. Under the circumstances, the arrangement method and operation of the light projecting part 41 and the light receiving part 42 are similar to the disclosure of FIG. 5 to FIG. 11 and thus descriptions thereof are omitted.

In the embodiments of the invention described above, the print head incorporated in the ink mechanism of the printer may discharge droplets of a fluid obtained by mixing cosmetics or medicine for skin into a liquid in place of the ink. Thereby, cosmetics or medicine may be applied to human skin with high accuracy, for example.

As described above, the invention achieves high practicability in preventing the discharge part of the ejection device from contacting the object and therefore is very useful and has high industrial applicability.

What is claimed is:

1. An ejection device, comprising:

a discharge part discharging a droplet to an object;

a light projecting part projecting a light between the discharge part and the object to form a light path without contacting the object;

a light receiving part receiving the light projected by the light projecting part; and a controller stopping driving the discharge part when the light receiving part does not receive the light due to a movement of the object blocking the light path.

2. The ejection device according to claim 1, comprising an object placing part on which the object is placed.

3. The ejection device according to claim 1, wherein the light path inclines at a predetermined angle with respect to at least a first direction of the discharge part.

4. The ejection device according to claim 1, wherein the light projecting part and the light receiving part are disposed outside a movement range of the discharge part.

5. The ejection device according to claim 1, comprising a reflecting part reflecting the light projected by the light projecting part to propagate across the object at least one time.

6. The ejection device according to claim 5, wherein the reflecting part is disposed respectively on one end side and another end side of the object.

7. The ejection device according to claim 4, wherein the light projecting part and the light receiving part are disposed respectively on one end side and another end side of the object.

8. The ejection device according to claim 3, wherein the light projecting part and the light receiving part are disposed on one end side of the object in the first direction.

9. The ejection device according to claim 8, wherein the light projecting part and the light receiving part are mounted on a substrate.

10. The ejection device according to claim 3, wherein the light projecting part and the light receiving part are directed in a second direction from the object and disposed at separated positions, wherein the second direction is perpendicular to the first direction and are away from the object.

11. The ejection device according to claim 10, wherein the light projecting part comprises a light projecting side guiding part that guides the light projected by the light projecting part to propagates across the object.

12. The ejection device according to claim 11, wherein the light receiving part comprises a light receiving side guiding part that guides the light propagates across the object to the light receiving part.

13. The ejection device according to claim 1, wherein the light projecting part comprises a line laser light source that is disposed on one end side of the object in the first direction and projects a laser light that spreads radially to form a light path across the object.

14. The ejection device according to claim 13, wherein a plurality of the light receiving parts are disposed on another end side of the object in the first direction.

15. The ejection device according to claim 1, wherein the controller stops a motor of the discharge part to stop driving the discharge part.

16. The ejection device according to claim 15, wherein the controller controls to turn off a power supply of a driver of the motor to stop driving the discharge part.

17. The ejection device according to claim 1, further comprising a display that displays an error message indicating that driving the discharge part is stopped.

18. The ejection device according to claim 3, wherein discharging is performed by discharging the droplet to the object while the discharge part moving at least along the first direction.

* * * * *